US006557958B1

(12) United States Patent
Motta et al.

(10) Patent No.: US 6,557,958 B1
(45) Date of Patent: May 6, 2003

(54) STORAGE BIN WITH COUNTERBALANCED DOOR

(75) Inventors: Giuseppe Luigi Motta, Bellagio (IT); Piero Molteni, Milan (IT)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 09/807,713

(22) PCT Filed: Oct. 20, 1999

(86) PCT No.: PCT/EP99/08137

§ 371 (c)(1),
(2), (4) Date: Apr. 17, 2001

(87) PCT Pub. No.: WO00/23683

PCT Pub. Date: Apr. 27, 2000

(30) Foreign Application Priority Data

Oct. 20, 1998 (IT) ..... MI98A2251

(51) Int. Cl.[7] ..... E05D 15/40
(52) U.S. Cl. ..... 312/319.2; 312/325; 49/206
(58) Field of Search ..... 49/197, 200, 204, 49/205, 206, 260; 312/319.4, 319.2, 328

(56) References Cited

U.S. PATENT DOCUMENTS

| | | | | |
|---|---|---|---|---|
| 1,384,530 | A | | 7/1921 | Knauft |
| 1,879,798 | A | | 9/1932 | Ferris |
| 1,940,408 | A | | 12/1933 | Ferris |
| 2,129,221 | A | | 9/1938 | Lewis |
| 2,745,147 | A | | 5/1956 | Berry |
| 3,055,724 | A | * | 9/1962 | Mazure ..... 312/325 |
| 3,308,581 | A | | 3/1967 | Gustavsson |
| 3,545,132 | A | | 12/1970 | Hormann et al. |
| 4,035,954 | A | | 7/1977 | Hoff |
| 5,172,969 | A | | 12/1992 | Reuter et al. |
| D339,934 | S | | 10/1993 | Reuter |
| 5,257,852 | A | | 11/1993 | Tsuneki et al. |
| 5,409,308 | A | | 4/1995 | Reuter et al. |
| 5,524,979 | A | | 6/1996 | Carson et al. |
| 5,645,333 | A | | 7/1997 | Sakurai |
| 5,758,937 | A | | 6/1998 | Lammens et al. |
| 5,845,980 | A | | 12/1998 | Fricano et al. |
| 5,904,411 | A | | 5/1999 | Hayakawa |

FOREIGN PATENT DOCUMENTS

| | | | |
|---|---|---|---|
| DE | 3638503 C | * | 7/1987 |
| GB | 397949 A | * | 9/1933 |
| GB | 2226586 A | * | 7/1990 |

* cited by examiner

*Primary Examiner*—Lanna Mai
*Assistant Examiner*—Jerry A. Anderson
(74) *Attorney, Agent, or Firm*—Price, Heneveld, Cooper, DeWitt & Litton

(57) ABSTRACT

An assembly includes panels forming a bin or cabinet, and a flipper door operably attached to the bin by a pair of opposing modules. Each module includes a body forming a groove forming a curvilinear track along its upper edge, and the door includes a follower operably engaging the track. Each module further includes a spring-biased lever pivoted to the body of the module at a mid-lever pivot. A first leg of the lever is pivoted to the door at a door pivot, and an oppositely extending second leg is connected to a spring-biased force-generating device. The arrangement is constructed to counterbalance a weight of the door in most intermediate positions.

38 Claims, 4 Drawing Sheets

STORAGE BIN WITH COUNTERBALANCED DOOR

BACKGROUND OF THE INVENTION

The present invention relates to binder bins and storage cabinets having a closeble door.

Doors are often hinged or otherwise operably supported on bins and cabinets for movement between opened and closed positions. In such cabinets, hinge mechanisms are often provided that positions the door, when in the opened position, in or on the cabinets. A problem is that these doors can accidentally fall downwardly with gravity if the doors are prematurely released. Some bin and cabinet manufacturers have constructed mechanisms to reduce the potential or likelihood of such accidental downward movement, such as by use of dampeners, biasing devices, and other mechanisms to control the movement of the doors. However, most known alternatives are costly, include an unacceptable number of components, are mechanically complex, and/or are difficult to assemble. Further, many of these known alternatives take up a significant amount of space within the bins or are unattractive in appearance. Another disadvantage is that many known alternatives are not easily adapted to different cabinet shapes and constructions.

An apparatus is desired solving the aforementioned problems, and having the aforementioned advantages. In particular, an apparatus is desired that is mechanically simple, low in cost, easy to install, and yet that provides an attractive feel to users. Further, an apparatus is desired that is potentially retrofitable into existing bin and cabinet assemblies.

SUMMARY OF THE INVENTION

The present invention concerns in a bin assembly having a door that is operably supported on the bin assembly for optimal self-controlled movement, and also counterbalanced to move easily between opened and closed positions. The present invention further concerns a hinge assembly constructed to facilitate a modular assembly.

In one aspect of the present invention, an assembly includes a bin having sides, a bottom, and a top defining an access opening. A door is configured to close the access opening and a track is located along each side of the bin proximate the top. A lever is pivoted to each side at a lever pivot and spaced from the track. The door includes followers that slidably engage the tracks and bottom connectors pivotally attached to the levers. The tracks and the followers are configured to slidingly guide a top of the door, and the levers are configured to pivotally guide a bottom of the door as the door is moved between a closed position and an open position. A force-generating device is attached to the lever for balancing a weight of the door as the door is opened and closed.

In another aspect of the present invention, an assembly includes a bin having sides and curvilinear tracks defining an access opening. The curvilinear tracks on the sides extend along the top and are located near the top. A door includes followers engaging the tracks.

In yet another aspect of the present invention, a furniture apparatus includes a shelf and side modules connected together to define a space on the shelf and an access opening to the space. The side modules each include a lever and a track spaced from the lever. A door is pivotally connected to the levers at a first location and slidably engages the tracks at a second location. The door is operably supported by the levers and the tracks for movement between a first position closing the access opening and a second position uncovering the access opening.

In still another aspect of the present invention, an assembly includes a bin having sides defining an access opening. A pair of opposing levers is each pivotally supported on a respective one of the sides by fixed lever pivots. Each lever includes first and second legs that extend in opposing directions from their respective lever pivots. A door is pivoted to the first legs for movement between opened and closed positions. A biasing device is connected to the second legs. The biasing device and levers are constructed to impart a lifting force to the door that approximates a weight of the door on the levers, so that the door remains stationary when released in a range of intermediate positions between the opened and closed positions.

In still another aspect of the present invention, an assembly includes a bin defining an access opening. A door is configured to close the opening when in a closed position to allow access through the access opening when in an opened position, and to move through intermediate positions between the opened and closed positions. A door-biasing-and-supporting module is attached to the bin and the door, and is configured to hold the door in a stationary position when released in one of the intermediate positions, but is configured to move the door to the closed position when the door is released within a predetermined distance from the closed position.

In still another aspect of the present invention, a method includes steps or providing a bin having an access opening for accessing the bin. A door selectively covers the opening and is operably supported on the bin for movement between a closed position, an opened position, and at least one intermediate position. The method further includes holding the door in a stationary position when the door is released by an operator in the at least one intermediate position.

In yet another aspect of the present invention, a module for operably mounting a door to a bin for movement between opened, intermediate, and closed positions includes a body having a top section defining a track, a bottom section, and an intermediate section defining a lever pivot. A lever is pivoted to the lever pivot and includes a first leg extending from the lever pivot that is configured for operable attachment to the door. A biasing device is anchored to the body and operably attached to the lever. The biasing device is configured to bias the lever between the opened, intermediate, and closed positions in a manner that, when the biasing device is connected to the door, at least partially balances a weight of the door.

These and other features, advantages, and objects of the present invention will be further understood and appreciated by those skilled in the art by reference to the following specification, claims, and appended drawings.

DETAILED DESCRIPTION OF PREFERRED EMBODIMENTS

Figure 1:
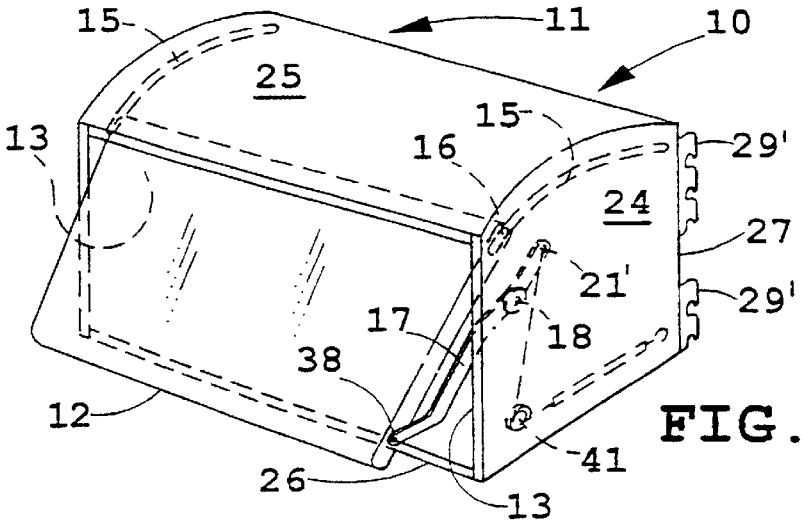
FIG. 1 is a perspective view of an assembly embodying the present invention, with a door of the assembly being shown in a partially opened position.

For purposes of description herein, the terms "upper," "lower," "left," "rear," "front," "vertical," "horizontal," and derivatives thereof shall relate to the invention as oriented with a person standing in front of the door and opening the same, as shown in FIG. 1. However, it is to be understood that the invention may assume various orientations and step sequences, except where expressively specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressively state otherwise.

Figure 6:
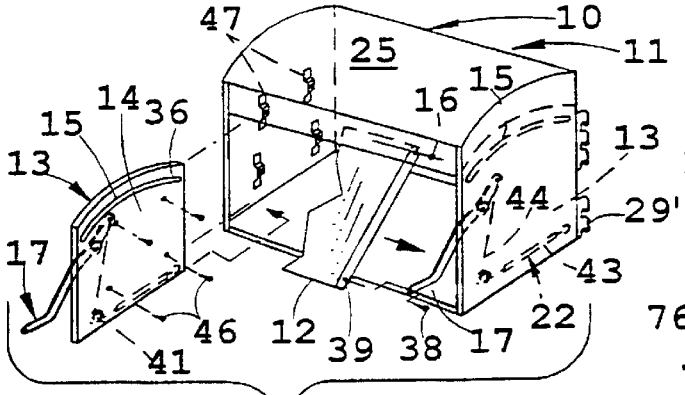
FIG. 6 is an exploded perspective view of the cabinet assembly shown in FIG. 1.

The illustrated/preferred structure comprises a binder bin or cabinet assembly 10 (FIG. 1) including panels forming a bin or cabinet 11, and further including a flipper door 12 operably attached to the cabinet 11 by a pair of opposing modules 13. Each module 13 includes a body 14 (FIG. 6) having a groove forming a curvilinear track 15 along its upper edge, and the door 12 includes a follower or slide bearing 16 operably engaging the track 15. Each module 13 further includes a spring-biased lever 17 pivoted to the body 14 of the module 13 at a mid-lever pivot 18. A first leg 19 of the lever 17 is pivoted to the door 12 at a door pivot 20, and an oppositely extending second leg 21 is connected to a spring-biased force-generating device 22 at location 21'. The arrangement is constructed to counterbalance a weight of the door 12 in a range of intermediate positions, such that the door 12 remains stationary in most positions if released. However, the door 12 is easily moved from any selected stationary position without having to overcome substantial braking forces and without having to overcome a weight of the door 12. Further, the construction is such that the door 12 is biased to a fully closed position if released at a predetermined distance relatively close to the closed position, and also is such that the door 12 is biased to a fully opened position if released at a predetermined location relatively close to the opened position. For example, the illustrated construction will gently automatically close on its own if the door 12 is positioned within about 5 to 8 centimeters from the fully closed position. Similarly, the door 12 will gently automatically open if positioned within about 5 to 8 centimeters from the fully opened position. Notably, the module 13 greatly facilitates assembly by providing a preassembled modular unit that can be easily positioned adjacent a side of the cabinet 11 and attached to the side of the cabinet 11 and to the door 12 with minimal effort.

Figure 4:
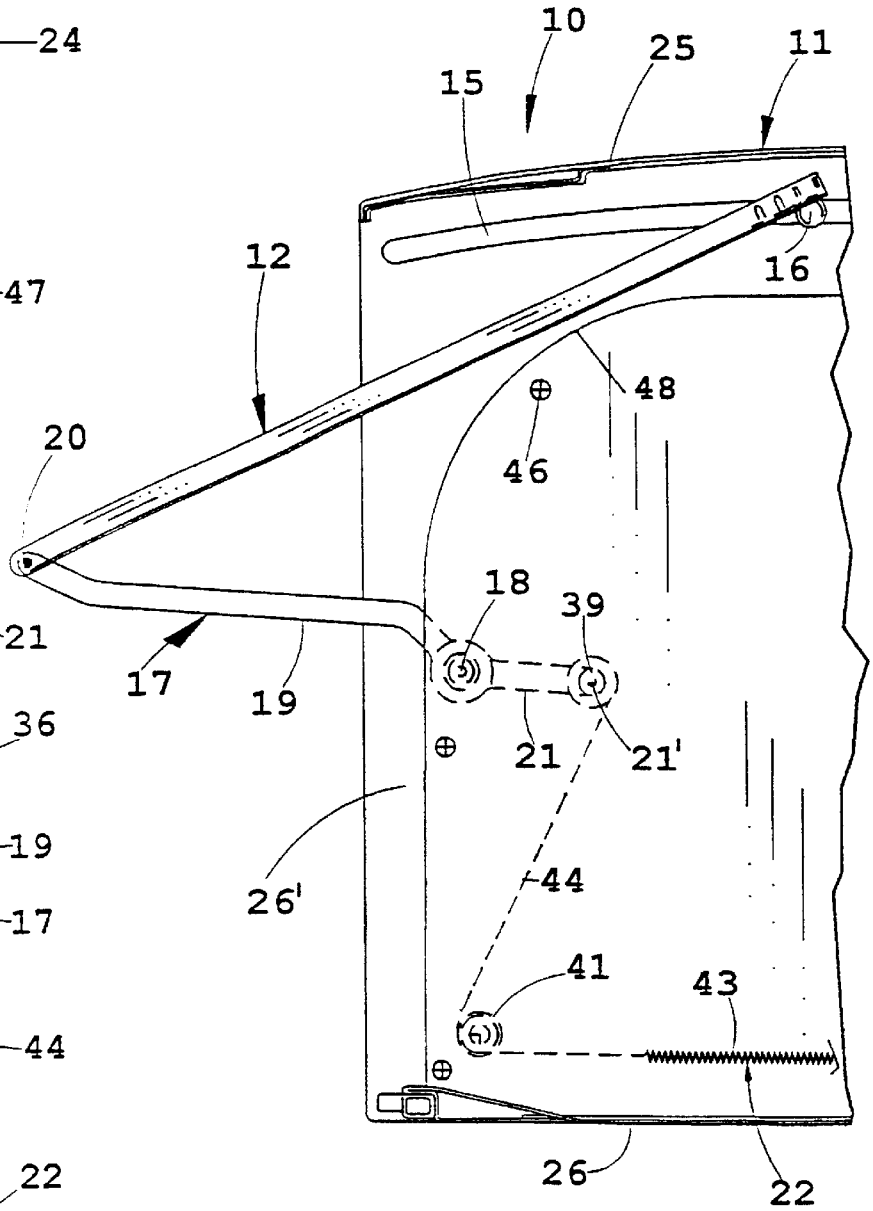
FIGS. 4 and 5 are cross-sectional views similar to FIG. 2, but showing the door in a partially opened position and a fully opened position, respectively.

The cabinet 11 (FIG. 2) includes panels forming sides 24, a top 25, a bottom 26, and a back 27 that define a front opening 26' (FIG. 4). Notably, it is contemplated that the back 27 can be omitted, and even the top 25 or bottom 26 can be omitted, with the side-mounted modules 13 still being functional and working to support a door 12. For example, this could be done on a shelf arrangement with sidewall dividers (see FIG. 9). If the back 27 were omitted, the cabinet 11 would still be secure if the cabinet 11 was securely fastened to a partition panel (not specifically shown), for example. The illustrated top 25 is curved from front to rear with a concave surface having a raised middle section. This shape provides added clearance for the door 12 as it is opened and closed (see FIG. 4). The arcuate shape is aesthetically pleasing. Nonetheless, it is contemplated that the present invention can be used on a bin with a flat top. Notably, the shape of the curvature can be varied and can be made to correspond to the shape of the track 15, if desired, so that an upper edge of the door 12 closely follows the top 25 as the door 12 is opened, although such parallel shape is not required for proper function. The panels 24–27 are stiffened and reinforced as required, such as by additional stiffeners 28 (FIG. 2), or by forming bends 29 in the panels, or by providing materials having sufficient thickness and strength to achieve the desired stiffness. The cabinet 11 can be a stand alone furniture item or can be constructed for attachment to partitions or other structures in ways known in the art, such as by incorporation of hooks 29' (FIG. 6) and/or other connectors to a rear of the cabinet 11. The panels 24–27 are constructed from various materials, such as metal, wood, plastic, and composites, and are assembled together by ways known in art including welding, adhering, bonding, screwing, and numerous other mechanical and chemical means.

Figure 8:
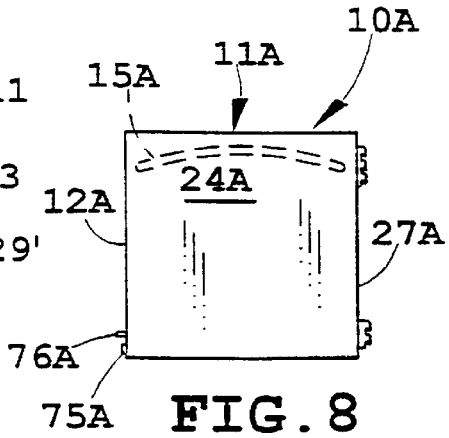
FIG. 8 is a side elevational view of the cabinet assembly shown in FIG. 7.

The door 12 (FIG. 6) includes a panel constructed of material known in the art, such as plastic, wood, metal, composites, and the like. It is noted that illustrated door 12 is flat, although it could be curved if desired to match the top 25. The door follower 16 includes a laterally extending protrusion 31 (FIG. 2B), such as a shafted or threaded fastener screwed into a side surface of the door 12 proximate its upper edge. The protrusion 31 includes an end extending laterally, and a lubricious hat-shaped bearing 32 is engaged with the protruding end. The bearing 32 can be made lubricious by coating it with grease or by making it from a low friction polymer. The hat-shaped bearing 32 includes a hole that receives the protrusion 31, and further includes a small end 33 that slidingly engages the track 15, and still further includes a larger washer-like end 34 that spaces the side edge of the door 12 from the side panel 24 of the cabinet 11. It should be noted that some friction is inherent in the system, and in fact is desired to better hold the door 12 in a stationary position when the door is released in an intermediate position. Nonetheless, the amount of friction is contemplated to be only a very low amount in a preferred form of the present bin assembly 10. Notably, the door 12 can include a door lock 75A, a handle, and other hardware commonly associated with cabinet doors (see FIGS. 7 and 8). Also, it is noted that the door could be curved, such as to aesthetically and functionally match the curved top 25.

The modules 13 (FIG. 6) include the module body 14, which is about a ½ inch in total thickness. The module body 14 is generally rectangular to fit mateably into an end of the cabinet 11 against a side panel 24. The module body 14 can be made of several different materials, and as metal or plastic, and can be formed in many different ways, such as by injection molding, machining, stamping, or welding.

Further, the body 14 can be substantially the size of the sides 24, or can be smaller than the sides 24 in one or more directions, or can replace the sides 24 (if properly constructed) per se.

In the illustrated module body 14, the track 15 is integrally formed therein and extends generally arcuately rearwardly across a top edge thereof. A rear section of the track 15 is recessed downwardly at location 36 to form a detent that the follower 16 drops into upon fully opening the door 12. This recess can assist in moving the door its last few inches during opening. The body 14 defines a cavity for operably receiving the force-generating device 22, and further includes bosses or the like for operably mounting parts of the force-generating device 22, as discussed below.

The lever 17 (FIG. 3) comprises a stiff metal stamping that is pivoted to the mid-lever pivot 18 by an axle 36 fixed to module body 14. The axle 36 is strategically located to provide an optimal counterbalancing force in the arrangement. The illustrated mid-lever pivot 18 is located at about 3 to 5 centimeters rearward from a front of the cabinet 11, and is located at or about 1 to 2 centimeters above a middle of the cabinet 11, for the cabinet that is about 40 to 45 centimeters tall at its front. The mid-lever pivot 18 divides the lever 17 into the first leg 19 and the second leg 21. The first leg 19, when the door 12 is closed, extends forwardly and downwardly to a bottom of the door 12 (see FIG. 2). The door 12 includes a slot 37 (see FIG. 2A) in its rear surface 37' located near its outer/upper corner. The door pivot 20 includes a screw or pin 38 that extends through a blind hole 39 that is formed into a side edge of the door 12 through the slot 37. The pin 38 extends through a hole in the end of the first leg 19, pivotally capturing the first leg 19 in the slot 37 and to the door 12. As illustrated, the first leg 19 extends a dimension "A" that is about 22 to 23 centimeters (FIG. 3). In the closed position, the first leg 19 extends vertically downwardly from lever pivot 18 (FIG. 2) first angularly toward the door, and then parallel and adjacent the door, and then angularly into the door. This shape is important so that the first leg 19 is located adjacent the door to take a minimum of storage space in the assembly 10. The shape and pivot locations of first leg 19 are further important since they affect weight distribution and the operation of the door 12 as it is moved between opened and closed positions.

The second leg 21, when the door 12 is closed, extends radially upwardly from mid-lever pivot 18 a dimension "B" that is about 6 to 7 centimeters in a direction generally opposite to first leg 19 (FIG. 3). A connector 39 is attached to an outer end of the second leg 21. In the closed position, the second leg 21 extends vertically above the lever pivot 18 in an over-center position relative to the cable 44. This is important to proper door function.

The spring-biased force-generating device 22 (FIG. 2) includes a roller wheel 41 located on the module 13, so that the roller wheel 41 is located approximately at a bottom and front of the cabinet side 24 when the module 13 is installed. When installed, the roller wheel 41 is located about 5 to 6 centimeters upward from and about 5 to 6 centimeters rearward from the front lower corner of the cabinet 11. An anchor 42 is provided on the module 13 and is located toward a rear of the cabinet 11 when the module is installed. A long coil spring 43 is anchored to the anchor 42 and extends along bottom 26. It is contemplated that the coil spring 43 could be replaced with a gas spring or a gas-piston-and-cylinder-dampening device to control door movement. A cable 44 is connected to an opposite end of the spring 43 and extends from spring 43 around roller wheel 41 up to lever 17, where it is connected to the connector 39 on the end of second leg 21. Notably, it is contemplated that only a single force-generating device 22 is needed for functioning, but a pair of such devices are desired to provide a balance force that does not tend to twist or bind the door 12. The friction-generating device 22 can be added to wheel 41 to better hold the door 12 in a selection position when released. It is also contemplated that a dampener can be added to wheel 41 to dampen the movement of the door 12.

To assemble the present construction, the cabinet 11, the door 12, and the modules 13 are separately constructed. The modules 13 are then positioned in the cabinet 11 against the sides 24 and attached thereto, such as by screws 46 (FIG. 6) that extend through body 14 into brackets 47. Notably, the illustrated modules 13 are right and left handed, but it is contemplated that non-handed handed parts could be constructed by making both sides of the body 14 flat with a cavity therebetween for receiving levers 17 and force-generating device 22, if desired. The door 12 is then attached, with the followers 16 being positioned in the tracks 15, and then with the levers 17 being attached to the door pivots 20. In the non-handed version, the body 14 would provide depressions forming the track 15 on each side of the body 14.

In operation of the illustrated assembly 10, the tension of spring 43 pulls on cable 44, urging second leg 21 downwardly and urging first leg 19 upwardly. Depending on angular position of the lever 17, the interaction of the torque arm defined by the second leg 21 and the spring force results in a net force that counterbalances a weight of the door 12. Notably, the net force (or torque) provided by force-generating device 22 changes as the door 12 is opened, but so does the net weight of the door 12 on the lever 17 relative to the mid lever pivot 18. This is because the center of gravity of the door 12 shifts relative to the mid-lever pivot 18 and follower 16. Testing has shown that by selecting an appropriate set of dimensions, spring constant, and spring pretension, the door 12 will stay stationary if released in partially opened, intermediate positions. Concurrently, testing shows that in the illustrated 10, the door 12 will also automatically close or will automatically open if positioned within about 7 to 8 centimeters of the fully opened or fully closed positions. Advantageously, the illustrated door 12 will automatically close (or open) in about the last 7 to 8 centimeters of stroke for the door with a gentle but positive motion. The position and shape of the levers 17 and the pivots 18, 20, and 21 are very important to this feature. The recesses or downwardly extending depressions 36 formed in the ends of the track 15 also help and/or effect this function. Notably, the recesses can be located either at a front or at a rear of the track 15, or only need to be located in a rear. The curvilinear shape of the track 15 helps significantly in this automatic closure and/or the automatic opening. Minimizing the friction on the followers 16 and on the pivots 18 and 20 can also help, although it is also important to provide enough friction so the door 12 remains in a selected intermediate position when the door is released. Testing has shown that the friction necessary to hold the door in the illustrated intermediate position is relatively low, such that pressure from a single finger of a user can move the door. Nonetheless, it is contemplated that some significant designed-in friction of braking device could be added, if desired. Further, a counterbalance weight could be added to the second leg 21 to further assist in providing the optimal counterbalancing force desired. The construction of the bin assembly 10, such as the door weight, the inherent friction, the rigidity of the bins and door against twisting, and the like dictates the spring force requirements, which requirements are easily determinable by testing. It is noted that the shape and arrangement as shown in FIGS. 2, 4, and 5 are very close to scale of an exemplary embodiment, such that ratios of dimensions and the resultant torque and forces can be determined from the drawings, if desired, to better understand the relationship of components as the door 12 is opened.

Figure 2:
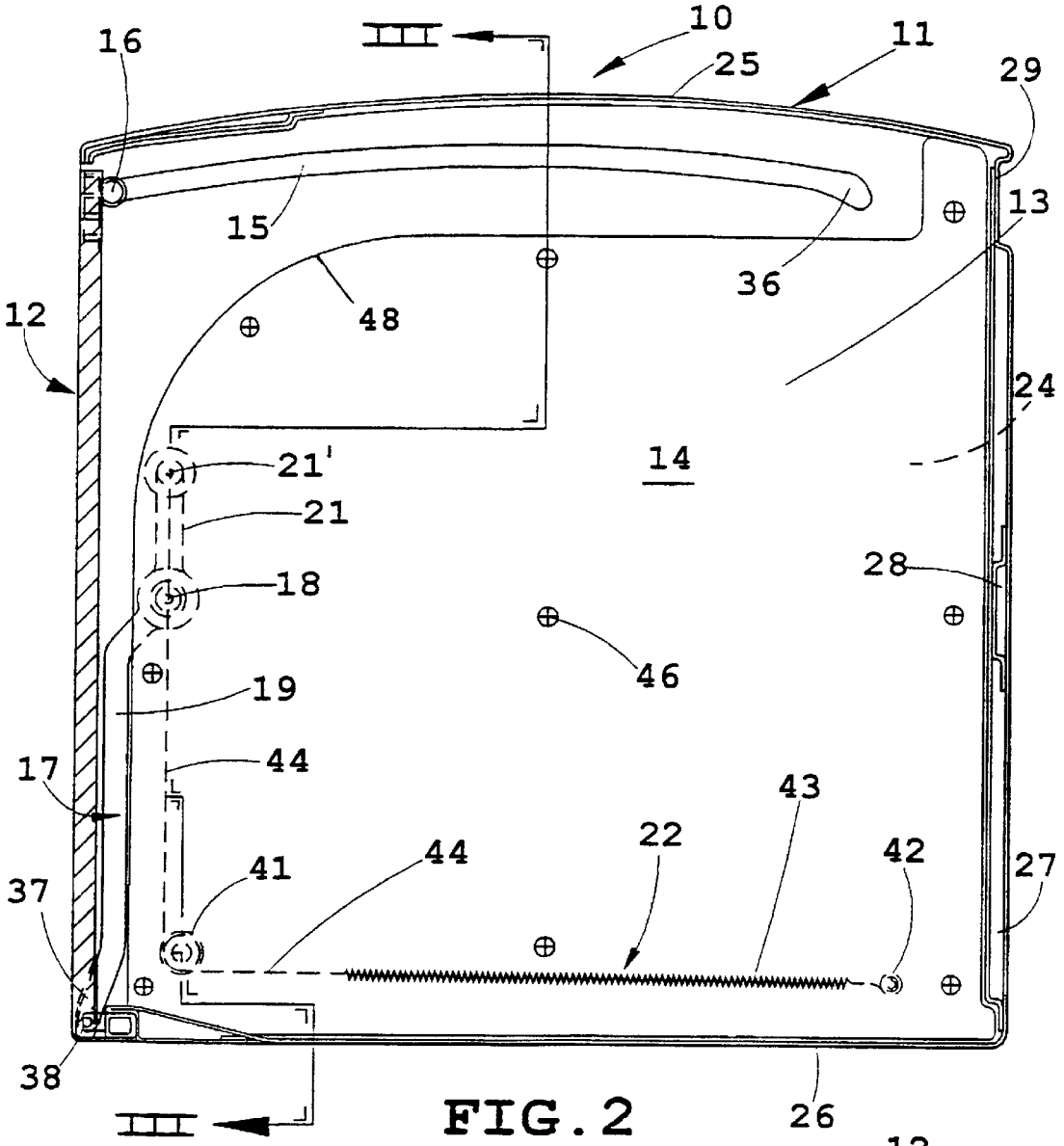
FIG. 2 is a cross-sectional view taken along the line II—II in FIG. 1, but showing the door in a closed position.
Figure 2A:
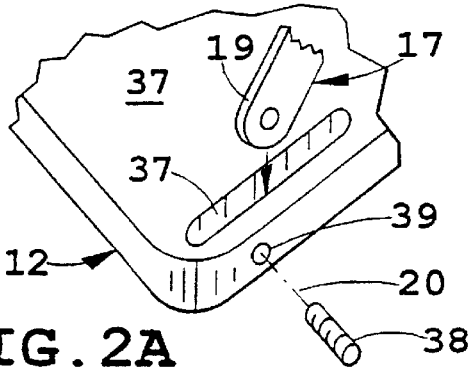
FIGS. 2A and 2B are exploded fragmentary perspective views of the upper and lower corners, respectively, of the door shown in FIG. 1.
Figure 2B:
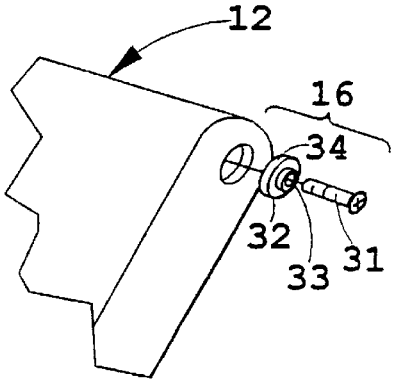
Figure 3:
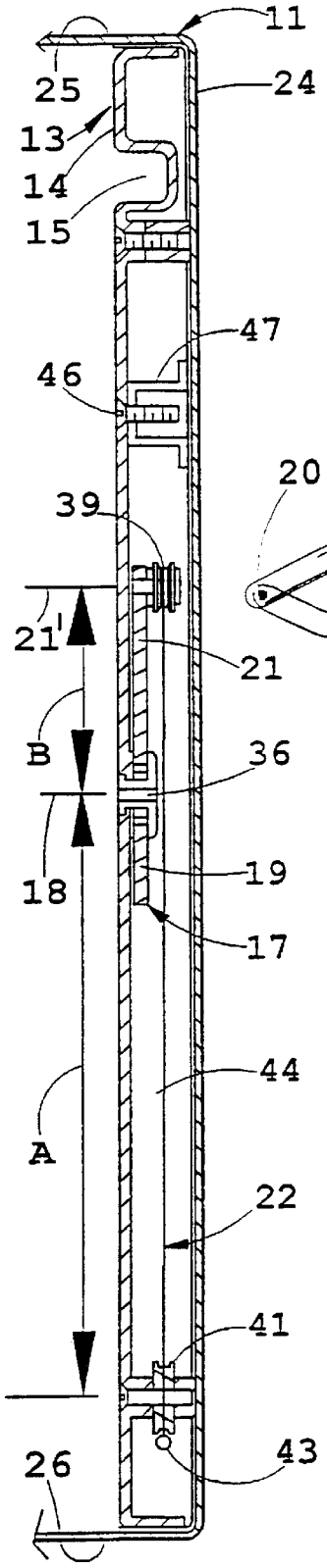
FIG. 3 is a cross-sectional view taken along the line III—III in FIG. 2.
Figure 5:
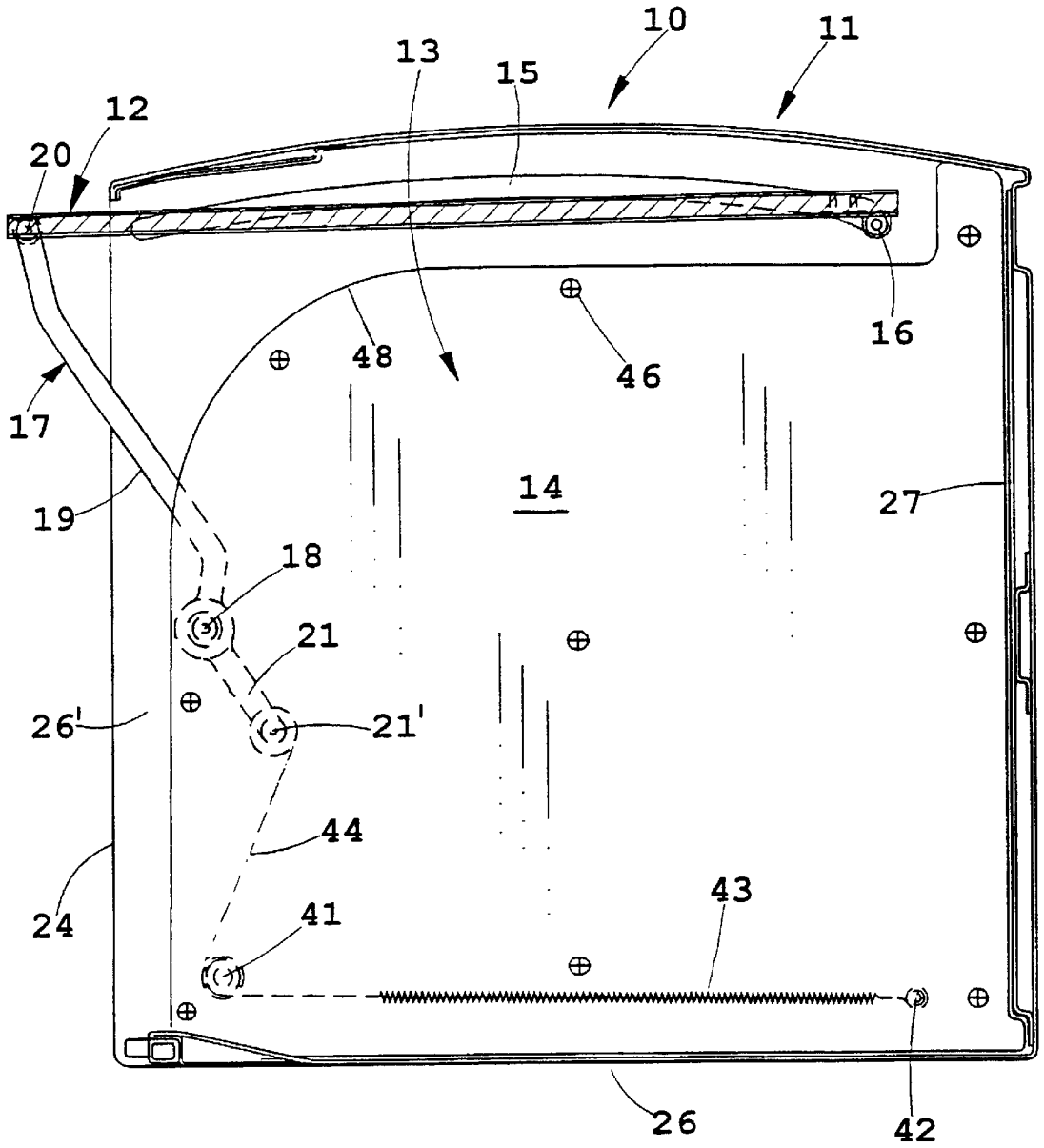

In FIGS. 2, 4, and 5, it is noted that a curvilinear line 48 highlights an outer boundary of the storage area within the cabinet 11. Articles must be stored within that outer boundary to avoid being struck by the door 12 as the door 12 is opened. The line 48 is particularly useful as a visual reference for users when storing items within the cabinet 11.

Figure 9:
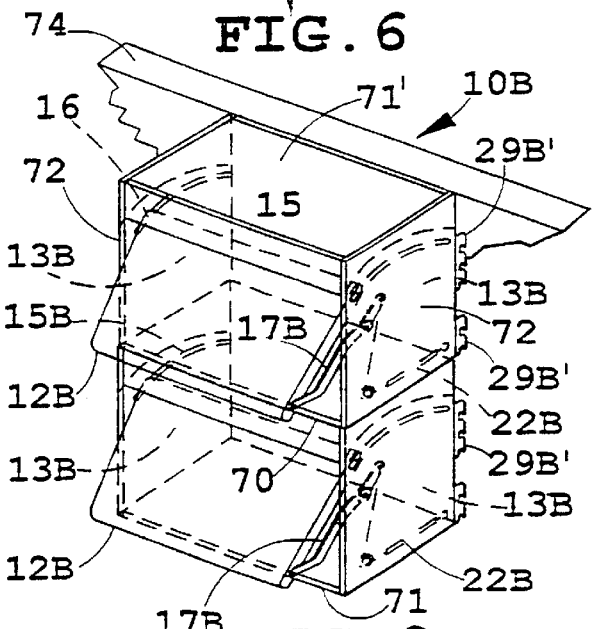
FIG. 9 is a perspective view of a further modified construction, wherein multiple storage spaces are formed by three vertically spaced shelves supported by two vertical panels, each of the storage spaces being provided with doors.
Figure 7:
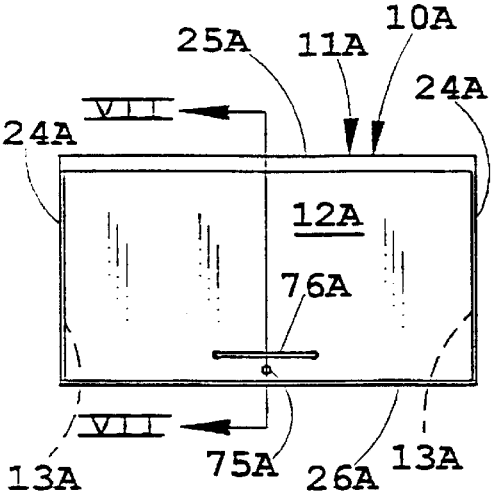
FIG. 7 is a front view of a modified cabinet assembly embodying the present invention.

The constructions 10A and 10B shown in FIGS. 7 and 9, respectively, are labeled by using the same members for identical and similar features and components, but with the addition of the letters "A" and "B", respectively. This is done to reduce redundant discussion.

The construction 10A comprises a cabinet 11A having an open back 27A. Further, the bottom 26A extends completely to a front of the cabinet 11A and the door 12A is cut short of the bottom 26A, such that the door 12A fits into a rectangular perimeter formed by the sides 24A, the top 25A and the bottom 26A. For this reason, a handle 76A is provided that can be grasped to pull the door 12A open. The door 12A is also shown with a lock 75A for illustrative purposes. Notably, the top 25A comprises a flat panel. The track 15A and also the front edge of the top 25A are modified in shape to permit the door 12A to open with an acceptable motion and function, while maintaining minimum gaps and clearances at a top edge of the door 12A. It is noted that the curvilinear shape of the tracks 15A are selected to keep the top edge of the door 12A close to but at a optimal clearance to the top 15A at all times, even though the followers are positioned rearward and below the top edge of the door. Also important the levers 17A reduce the forward movement of the door 12A as it is opened, thus reducing the clearances needed in front of the door to, for example, avoid hitting the head of a user.

The construction 10B includes vertically spaced shelves 70, 71, and 71', and a pair of horizontally spaced blades 72 and 73, all of which are supported on a partition panel or wall 74. Notably, as illustrated, the blades 72 and 73 include hooks 29B', so that they can be easily hung on and supported on a freestanding partition panel. Notably, the blades 72 and 73 can be extended above and below the shelves 70, 71, and 71', if desired. However, it is contemplated that instead the shelves 70 and 71 could be extended horizontally beyond the blades 72 and 73, with the blades 72 and 73 being vertically short enough to fit between the shelves 70 and 71. Notably, as shown, the top shelf 71' acts as a cover for the space above the middle shelf 70, and middle shelf 70 forms a top for bottom shelf 71, thus effectively forming cabinet spaces above shelves 70 and 71.

In the foregoing description, it will be readily appreciated by those skilled in the art that modifications may be made to the invention without departing from the concepts disclosed herein. Such modifications are to be considered as included in the following claims, unless these claims by their language expressly state otherwise.

What is claimed is:

1. An assembly comprising:

a bin including sites, a bottom, and a top defining an access opening;

a door configured to close the access opening;

a track located along each side of the bin proximate the top;

a lever pivoted to each side at a lever pivot and spaced from the track, the door including followers slidably engaging the tracks and bottom connectors pivotally attached to the levers, the tracks and the followers being configured to slidingly guide of the door, and the levers being configured to pivotally guide a bottom of the door as the door is moved between a closed position and an open position; and a force-generating device attached to the lever for balancing the weight of the door as the door is opened and closed, the force-generating device including a spring that extends along the bottom, and further including a cable operably extending from the spring to the lever, the cable being connected to the lever at a location spaced from the lever pivot, the spring generating a torsional force about the lever pivot on the lever.

2. The assembly defined in claim 1 wherein at least one of the sides includes a line that corresponds to a path of the door as the door is moved between the opened and closed positions to define an interference region within the cabinet.

3. The assembly defined in claim 1 including modules attached to the sides, the modules each including at least one of the tracks and at least one of the levers.

4. The assembly defined in claim 3 wherein the modules are each preassembled and attached as a modular unit to the sides.

5. The assembly defined in claim 4 wherein the modules are releasably attached to the side.

6. The assembly defined in claim 3 wherein the side includes brackets attached to an interior surface of the sides, the brackets being configured to receive screws to attach the respective module thereto.

7. The assembly defined in claim 1 wherein the levers each include a first leg that extends from the lever pivot to the door and a second leg that extends from the lever pivot to the force-generating device.

8. The assembly defined in claim 7 wherein the second leg extends in a direction generally opposite the first leg.

9. The assembly defined in claim 1 wherein the lever and the spring are configured to generate a counterbalance force that offsets a weight of the door, such that the door is held in a stationary position when released within a range of partially opened positions.

10. The assembly defined in claim 9; in which the curvilinear tracks extend along the top of the sides and are located near the top.

11. The assembly defined in claim 10 in which the levers each include a first leg pivoted to the door and a second leg that extends from the first leg generally to an opposite side of the associated lever pivot from the first leg, and in which the force-generating device is operably attached to at least one of the second legs and configured to create a torque on the one lever as the door is moved between opened and closed portions for torsionally balancing a weight of the door as the door is opened and closed.

12. The assembly defined in claim 10 wherein the top has a concave shape that faces downwardly and that closely matches a shape of the curvilinear tracks.

13. The assembly defined in claim 11 wherein the force-generating device provides a variable torque as an associate one of the second leg rotates around its associated lever pivot, the variable torque varying in a manner generally corresponding with a movement of the center of gravity of the door relative to the lever pivots, such that the force-generating device operatively holds the door in a stationary position when the door is released, despite differences in the torsional forces generated by the center of gravity of the door is moved between opened and closed positions.

14. The assembly defined in claim 1 wherein the levers each include a first leg that extends from the lever pivot to the door and a second leg that extends from the lever pivot in a substantially opposite direction from the first leg, and wherein the second legs are configured to extend vertically relative to the lever pivot when the door is in the closed position.

15. The assembly defined in claim 14 wherein the door includes a slot in its rear surface and a blind hole in a side surface, and wherein the first leg includes an end section that extends into the slot and that includes a second hole aligned with the blind hole, and further including a pivot pin that extends through the blind hole and through the second hole to pivotally connected the first leg to the door.

16. The assembly defined in claim 1 wherein an operable engagement between at least one follower and its respective lever pivot provides sufficient friction to hold the door in a selected intermediate position when released, the intermediate position being between the opened and closed portions.

17. The assembly defined in claim 16 wherein the follower provides sufficient friction in combination with the force-generating device to hold the door in the intermediate position when released.

18. The assembly defined in claim 1 wherein the tracks are curvilinear shaped to promote automatic closure by the force-generating device when the door is near the closed position.

19. The assembly defined in claim 1 wherein the tracks include a recessed area that promotes the door moving to fully opened position when the door is near the opened position.

20. The assembly defined in claim 1 wherein a rear section of the track is recessed downwardly to form a detent that receives the followers and assists in holding the door in the opened position.

21. An assembly as defined in claim 1 including a module for operably mounting the door to the bin for movement between opened, intermediate, and closed positions, the module including a body having a top section defining the track, a bottom section, and an intermediate section defining the lever pivot; and in which the lever includes a first leg extending from the lever pivot that is configured for operable attachment to the door; and in which the force-generating device is anchored to the body and operably attached to the lever, the force-generating device being configured to bias the lever between the opened, intermediate, and closed positions in a manner that, when the force-generating device is connected to the door, at least partially balances the weight of the door.

22. The assembly defined in claim 21 wherein the force-generating device includes coil spring.

23. The assembly defined in claim 22 including a cable that extends from the coil spring to the lever to operably connect the coil spring to the lever.

24. The assembly defined in claim 23 wherein the spring extends parallel to the bottom section.

25. The assembly defined in claim 24 including wheel pivoted to the bottom section, the cable extending around the wheel.

26. The assembly defined in claim 21 wherein the body includes a line that corresponds to a path of the door as the door is moved between opened and closed positions for indicating an interference region.

27. The assembly defined in claim 1 wherein the tracks are curvilinear.

28. The assembly defined in claim 1, in which each lever includes first and second legs extending in opposing directions from said lever pivots; and in which the door is pivoted to the first legs for movement between opened and closed positions; and in which the force-generating device is connected to the second legs to impart a lifting force to the door that approximates the weight of the door on the levers and so that the door remains stationary when released in a range of intermediate positions between the opened and closed positions.

29. The assembly defined in claim 28 wherein the force-generating device includes a coil spring.

30. The assembly defined in claim 29 wherein the coil spring is substantially elongated and provides a relatively constant coefficient of elasticity during stretching of the spring.

31. The assembly defined in claim 30 wherein the force-generating device includes a cable operably connected between the spring and the second leg.

32. The assembly defined in claim 31 wherein the force-generating device includes a wheel located generally at the front and bottom of the bin and the cable wraps around the wheel.

33. The assembly defined in claim 32 wherein the spring extends parallel a bottom of the bin.

34. The assembly defined in claim 28 wherein each first leg is located directly above its respective lever pivot when the door is in the closed position.

35. The assembly defined in claim 34 wherein the location of the lever pivots is slightly above a midpoint of the bin between a bottom of the bin and the top of a bin, and a further the second legs are positioned vertically over their respective lever pivots in an over-center position when the door is in the closed position.

36. The assembly defined in claim 10 wherein the top is curvilinear from a front edge to a rear edge of the bin.

37. The assembly defined in claim 36 wherein the tracks and the top are generally parallel to each other.

38. The assembly defined in claim 1 wherein the force-generating device is constructed to counterbalance a weight of the door.

* * * * *